US010086225B2

(12) United States Patent
Sheppard et al.

(10) Patent No.: US 10,086,225 B2
(45) Date of Patent: Oct. 2, 2018

(54) BOTTOM-HINGED INTERMEDIATE-LOCKING BARBELL HOLDER

(71) Applicant: Pangolin Design Group, LLC, Wilmington, DE (US)

(72) Inventors: Daniel Robert Sheppard, Escondido, CA (US); Andrew Christian Thomas, Jacksonville, FL (US)

(73) Assignee: Pangolin Design Group, LLC, Jacksonville, FL (US)

( * ) Notice: Subject to any disclaimer, the term of this patent is extended or adjusted under 35 U.S.C. 154(b) by 7 days.

(21) Appl. No.: 15/356,072

(22) Filed: Nov. 18, 2016

(65) Prior Publication Data

US 2018/0140890 A1 May 24, 2018

(51) Int. Cl.
*A63B 21/072* (2006.01)
*A63B 21/075* (2006.01)

(52) U.S. Cl.
CPC ..... *A63B 21/0722* (2015.10); *A63B 21/0726* (2013.01); *A63B 21/0728* (2013.01)

(58) Field of Classification Search
CPC ..... A63B 21/072; A63B 21/0728; A63B 21/0726
See application file for complete search history.

(56) References Cited

U.S. PATENT DOCUMENTS

| | | | | |
|---|---|---|---|---|
| 8,267,841 | B1 * | 9/2012 | Allison | A63B 21/06 482/106 |
| 9,149,680 | B2 * | 10/2015 | Thompson | A63B 21/0726 |
| 9,731,159 | B2 * | 8/2017 | Reynolds | A63B 21/0722 |
| 9,801,459 | B2 * | 10/2017 | Mundy | A63B 21/072 |
| 2011/0111929 | A1 * | 5/2011 | Allison | A63B 21/072 482/108 |
| 2012/0252641 | A1 * | 10/2012 | Odneal | A63B 21/072 482/108 |
| 2014/0024506 | A1 * | 1/2014 | Vixathep | A63B 21/0726 482/108 |
| 2014/0135186 | A1 * | 5/2014 | Reynolds | A63B 21/0726 482/108 |
| 2015/0105224 | A1 * | 4/2015 | Odneal | A63B 21/0726 482/107 |

* cited by examiner

*Primary Examiner* — Loan H Thanh
*Assistant Examiner* — Megan Anderson
(74) *Attorney, Agent, or Firm* — Mark Young, P.A.

(57) ABSTRACT

A bottom-hinged intermediate-locking barbell holder includes a pair of opposed holding bodies connected along their bottoms by a hinge. In a closed position, the handle sections form a handle for gripping and the bases define a generally cylindrical channel, near the hinged bottom, in which compressible gaskets and a handle of a dumbbell may be received and securely contained. A cam latch releasably secures the intermediate sections together.

17 Claims, 15 Drawing Sheets

BOTTOM-HINGED INTERMEDIATE-LOCKING BARBELL HOLDER

FIELD OF THE INVENTION

This invention relates generally to barbells, and, more particularly, to a bottom-hinged holder with an intermediate lock and a handle for adapting a barbell into a kettle bell.

BACKGROUND

A kettlebell is a dense, typically cast-iron or cast steel, exercise weight that resembles a ball with a U-shaped handle. In recent years, kettlebells have skyrocketed in popularity. Use of kettlebells in reality television programs, adoption by celebrities, and integration of kettlebells in wildly popular CrossFit curricula account for the growth in kettlebell popularity.

Barbells, particularly dumbbells (i.e., barbells with short handles) previously dominated the exercise weight market. Many individuals and gyms own many dumbbells, which remain entirely effective, but not ideal for kettlebell exercises.

A lightweight, cost-effective device that adapts to existing dumbbells to provide a kettlebell style handle is needed. The device should be easy to use and ergonomic, securely grip the dumbbell handle, and resist unintended dislodging.

The invention is directed to overcoming one or more of the problems and solving one or more of the needs as set forth above.

SUMMARY OF THE INVENTION

To solve one or more of the problems set forth above, in an exemplary implementation of the invention, a bottom-hinged intermediate-locking barbell holder is provided. The holder includes a pair of opposed holding bodies (a first body and a second body, collectively bodies) connected along their bottoms by a hinge. The bodies pivot between an open position and a closed position. In the open position, the bodies are pivoted apart. In the closed position, the bodies are abutting. Each body includes a handle section opposite the bottom, an intermediate section and a base at the bottom. In the closed position, the handle sections form a handle for gripping. When the handle is gripped, the holder is maintained in a closed position. In the closed position, the bases define a generally cylindrical channel near the hinged bottom. A handle of a dumbbell may be received and contained in the channel. The intermediate sections couple the handle sections of the holder to the bases. A locking mechanism is attached by another hinge to one body (i.e., the first body). The locking mechanism pivots between a locked position to an unlocked position. In the locked position, a cam latch of the locking mechanism secures the first body to the other body (i.e., the second body). In the unlocked position, the cam latch is pivoted away from the second body.

An exemplary holder for a dumbbell according to principles of the invention has a first body comprising a first handle section, a first intermediate section and a first base section, the first intermediate section being disposed between and connecting the first handle section to the first base section. The holder also has a second body comprising a second handle section, a second intermediate section and a second base section, the second intermediate section being disposed between and connecting the second handle section to the second base section. The first base section includes a first bottom, and the second base section includes a second bottom. A hinge couples the first bottom to the second bottom. The hinge enables pivoting motion of the first body relative to the second body between a closed position and an opened position. In the opened position the first body is pivoted away from the second body and in the closed position the first body abuts the second body. The first base section includes a first concave trough, and the second base section including a second concave trough. The first base section and the second base section are aligned and abutting in the closed position, and the first concave trough and the second concave trough are aligned and define a channel in the closed position. The channel is sized and shaped to receive a handle of a dumbbell. The hinge prevents a received handle of a dumbbell from dislodging from the channel through the first bottom and second bottom.

The first handle section and the second handle section each have a generally U-shaped profile. When aligned and abutting in the closed position, the first and second handle sections comprise a grippable handle that can be grabbed by a user's hand. When grabbed, the holder cannot pivot from the closed position to the open position.

In one embodiment, the hinge is comprised of a plurality of barrel sections, including a first set of barrel sections extending from the first bottom of the first base section, and a second set of barrel sections extending from the second bottom of the second base section. The first set of barrel sections and the second set of barrel sections interdigitate (e.g., interleave) and axially align. A shaft extends through the first set of barrel sections and the second set of barrel sections. The first set of barrel sections pivot about the shaft relative to the second set of barrel sections.

In an embodiment, a first compressible gasket is provided in the first concave trough and is about coterminous and coextensive with the first concave trough. A second compressible gasket is provided in the second concave trough and is about coterminous and coextensive with the second concave trough. The first compressible gasket and second compressible gasket are in opposed alignment in the closed position. The handle of the dumbbell is received between the first compressible gasket and the second compressible gasket in the closed position.

In an embodiment, a locking mechanism is attached to the first intermediate section by a lock hinge and releasably secures the first intermediate section to the second intermediate section. The locking mechanism pivots between an unlocked position and a locked position. The locking mechanism includes a cam latch. The second intermediate section includes a cavity with a catch such as a protruding ledge. The cam latch releasably engages the catch in the locked position.

BRIEF DESCRIPTION OF THE DRAWINGS

The foregoing and other aspects, objects, features and advantages of the invention will become better understood with reference to the following description, appended claims, and accompanying drawings, where:

Figure 1:
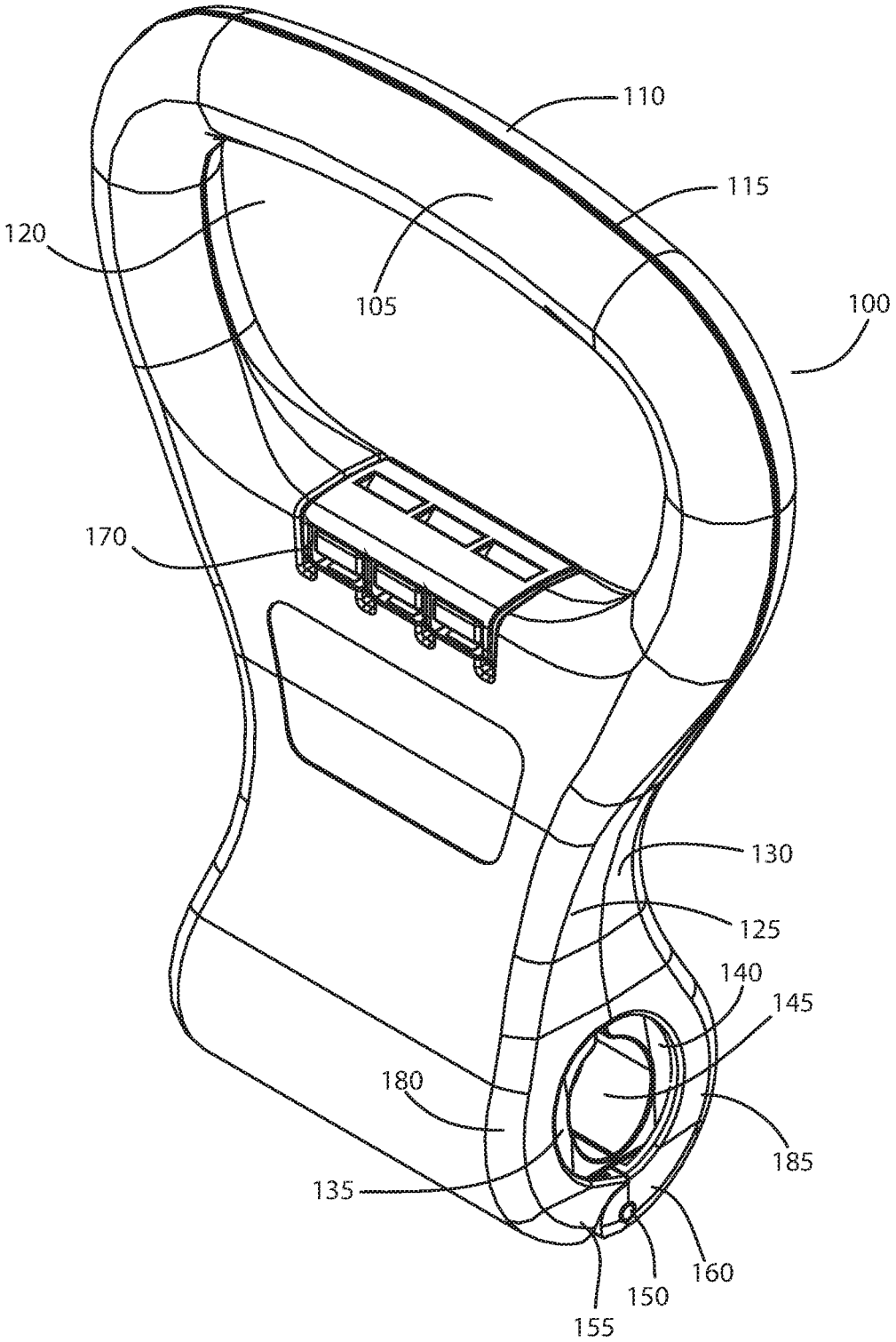
FIG. 1 is a perspective view of an exemplary holder in a closed configuration according to principles of the invention.
Figure 2:
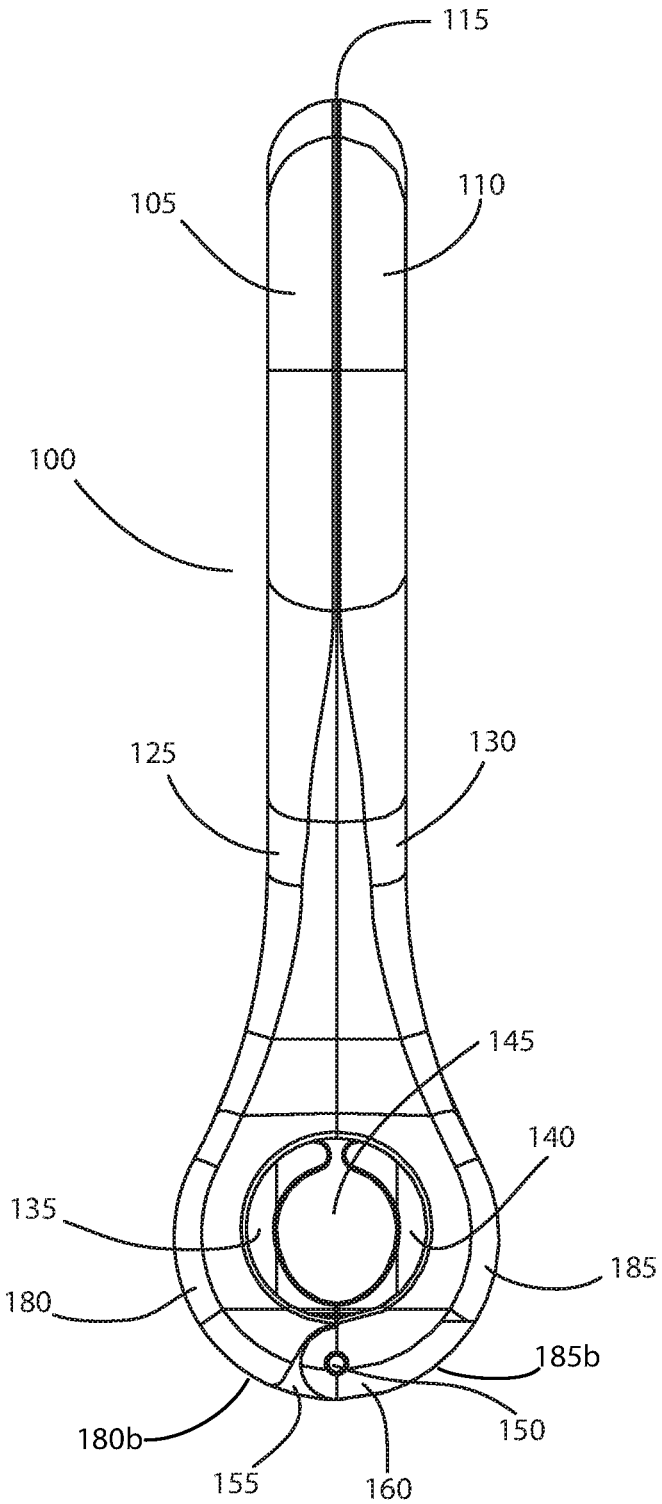
FIG. 2 is a first side view of an exemplary holder in a closed configuration according to principles of the invention.
Figure 3:
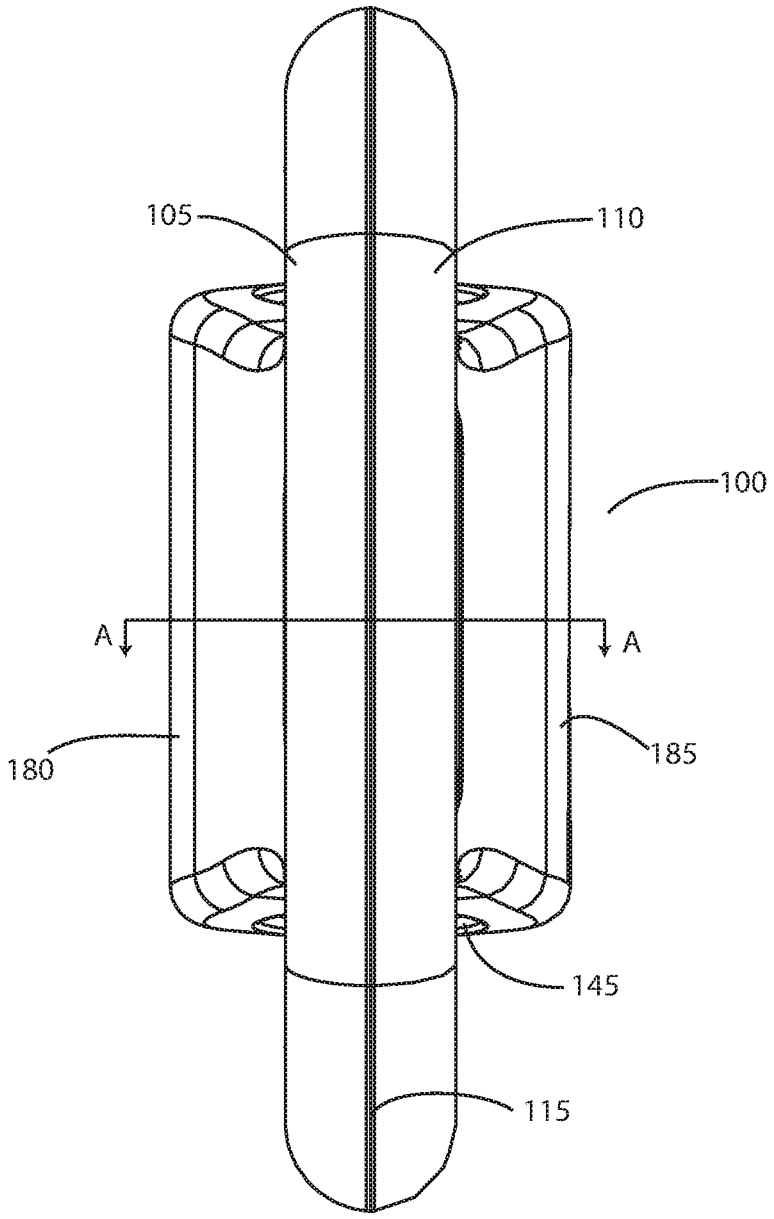
FIG. 3 is a plan view of an exemplary holder in a closed configuration according to principles of the invention.
Figure 4:
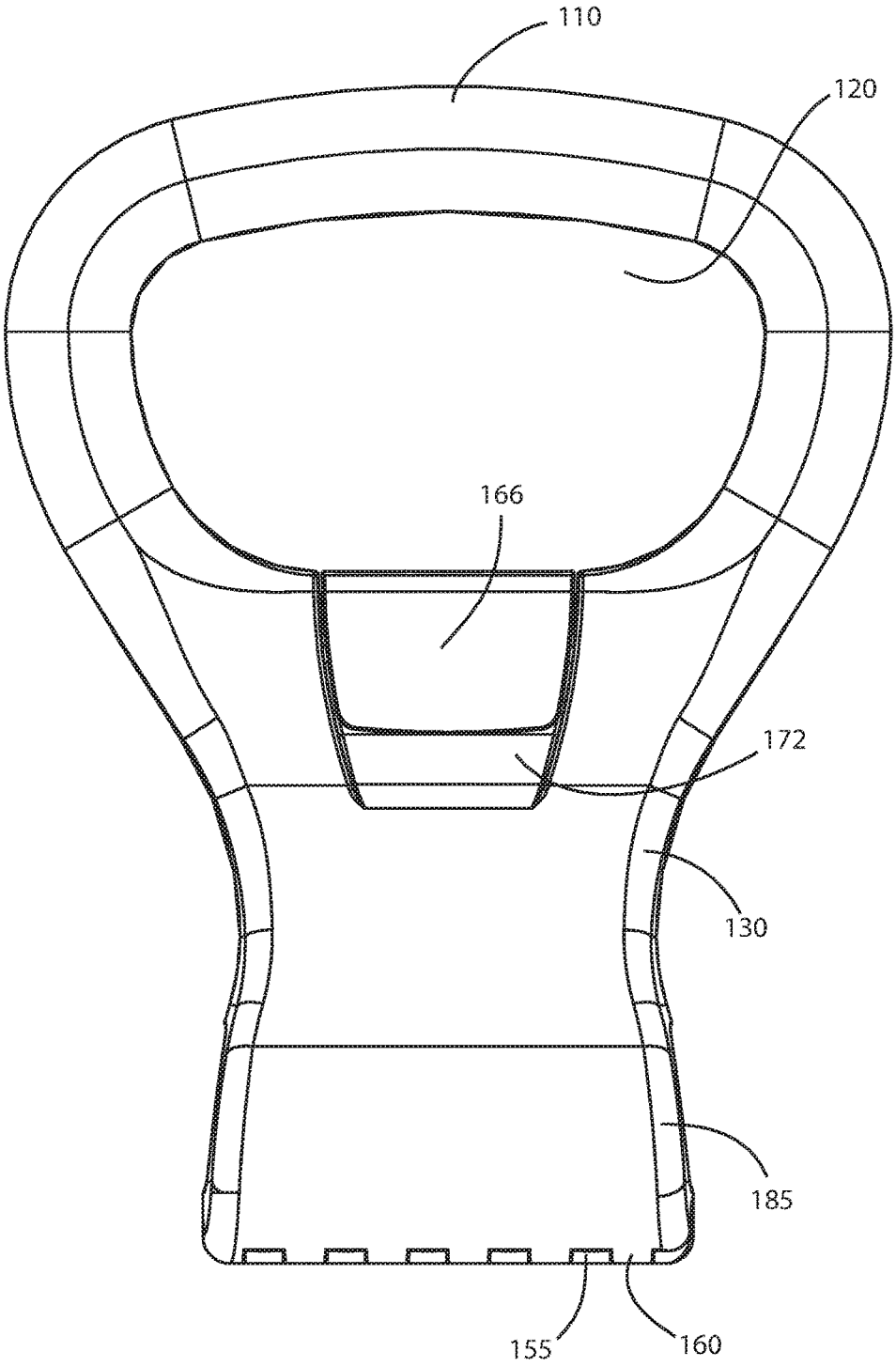
FIG. 4 is a front view of an exemplary holder in a closed configuration according to principles of the invention.
Figure 5:
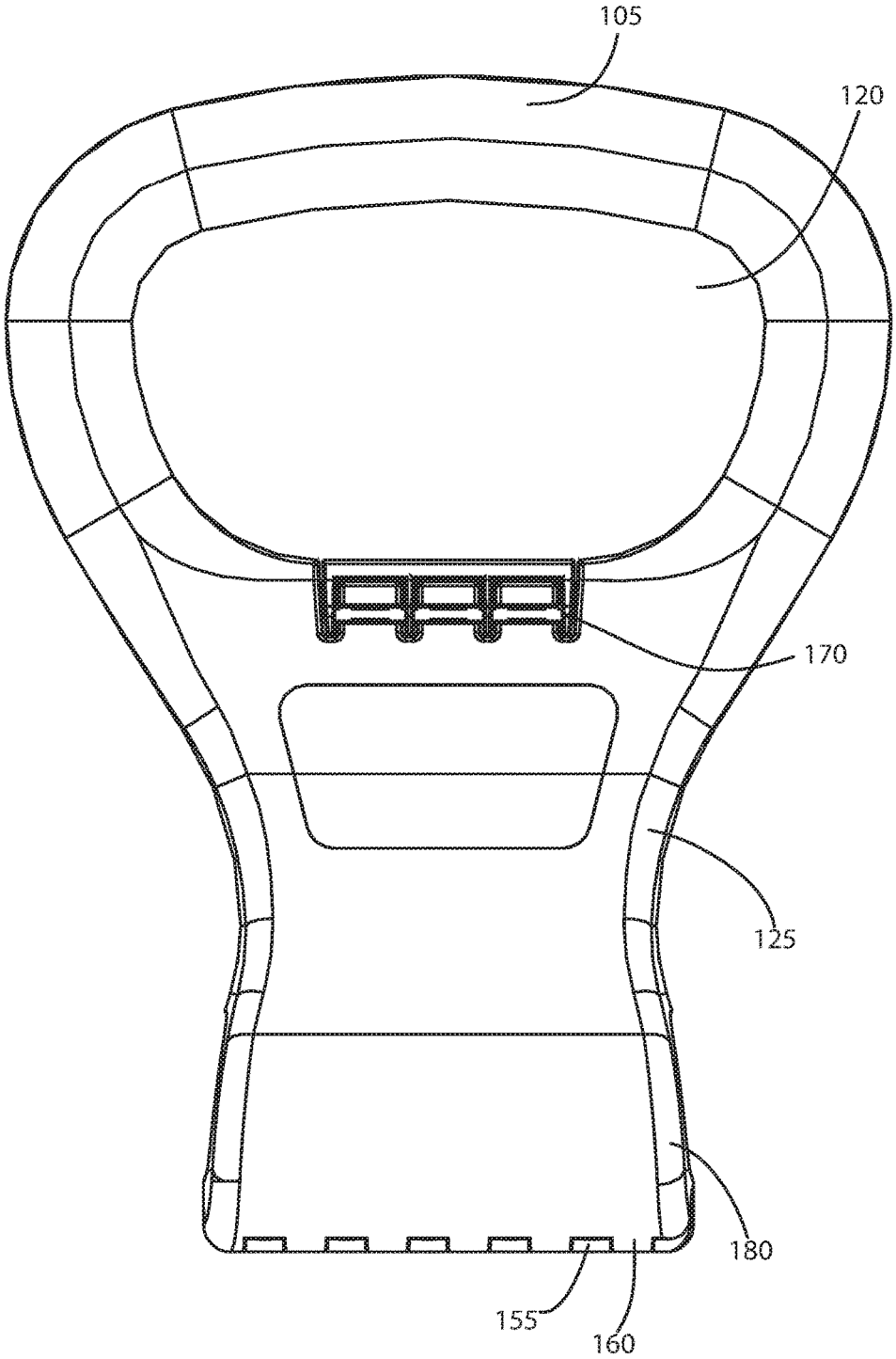
FIG. 5 is a back view of an exemplary holder in a closed configuration according to principles of the invention.
Figure 6:
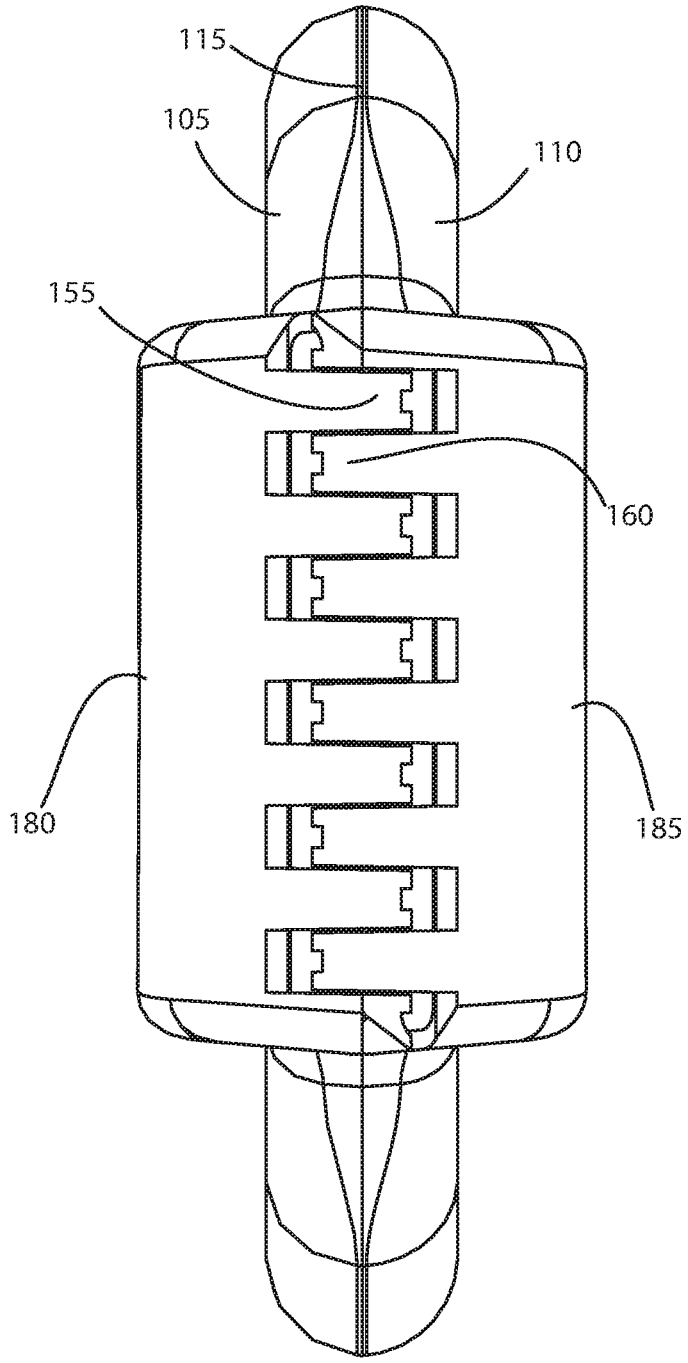
FIG. 6 is a bottom view of an exemplary holder in a closed configuration according to principles of the invention.

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

Referring now to FIGS. 1-6, an exemplary bottom hinged positive locking barbell holder 100 in a closed and locked position according to principles of the invention is conceptually illustrated. The holder 100 includes a pair of opposed bodies, each having a handle section 105, 110, an intermediate section 125, 130 and a base 180, 185. The bodies abut along an intersecting plane 115.

A hinge at the bottom 180*b*, 185 of each base 180, 185 couples the bodies. As more clearly illustrated in the bottom view of FIG. 6, the exemplary hinge includes interdigitating barrel segments 155, 160, which align to define a barrel through which a pin 150 extends. The interdigitating segments are interleaved, like fingers of interlocked hands, with immediately adjacent segments extending from opposite bodies. The bodies pivot about the pin 150, as shown more clearly in the exploded views of FIGS. 8 and 9. The interdigitating segments distribute stress along the hinge.

Figure 8:
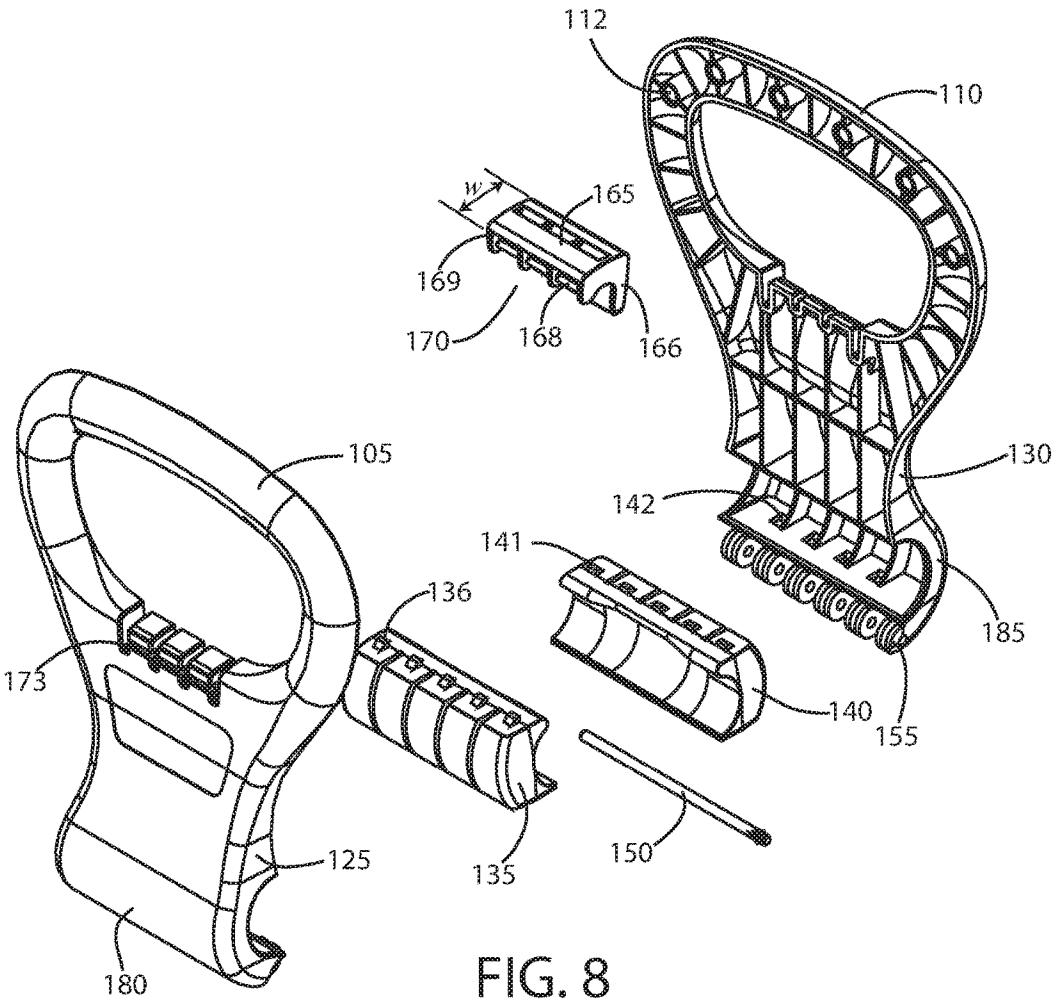
FIG. 8 is a first exploded perspective of an exemplary holder according to principles of the invention.
Figure 9:
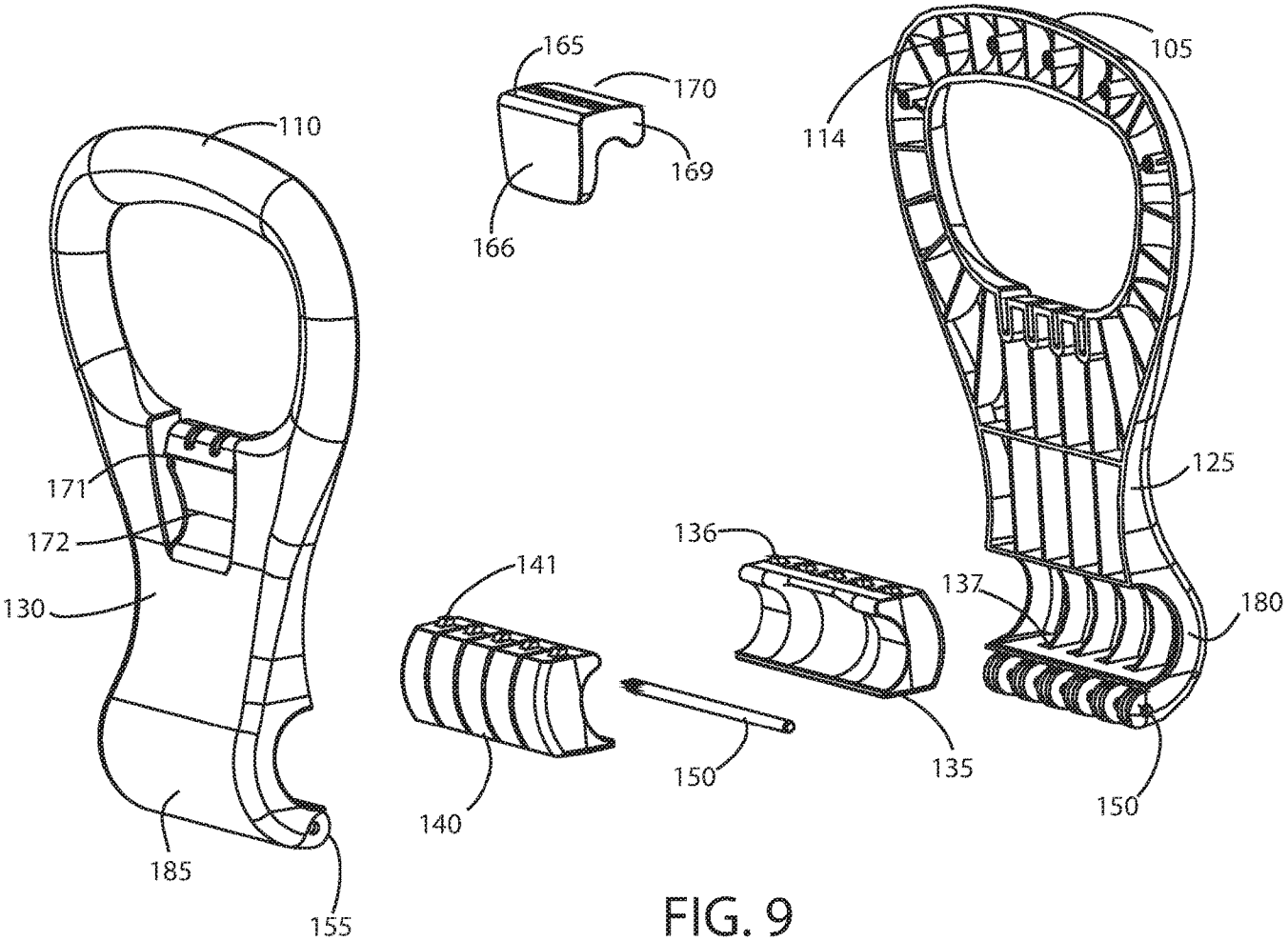
FIG. 9 is a second exploded perspective of an exemplary holder according to principles of the invention.
Figure 10:
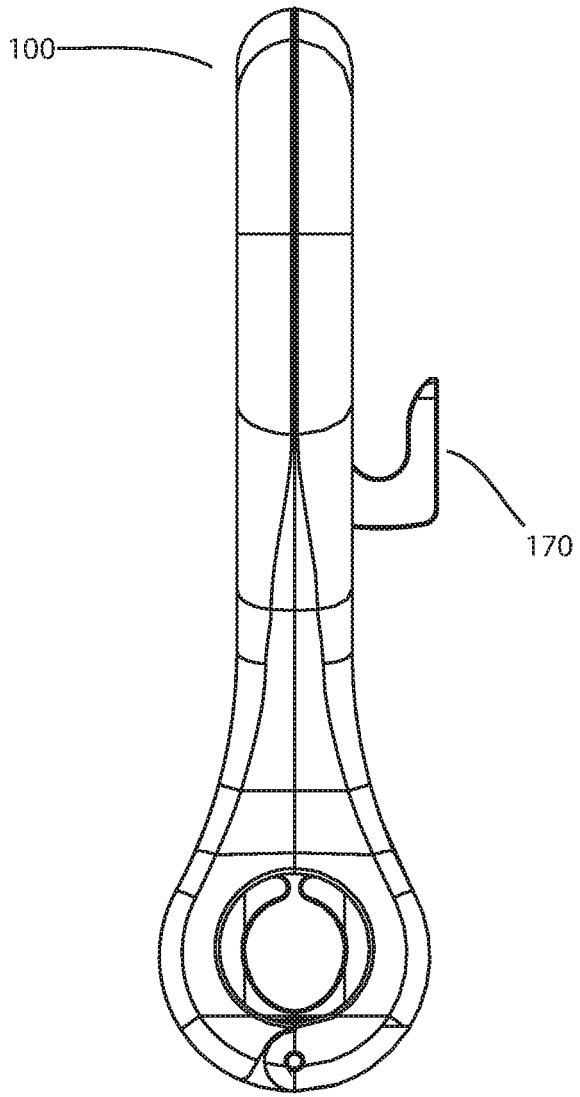
FIG. 10 is a side view of an exemplary holder in an unlocked configuration according to principles of the invention.

The bases 180, 185 include opposed concave troughs which define a channel 145 when the bases are in a closed position. The channel 145 is sized (i.e., in diameter and length) to receive the handle of a barbell. With reference to FIGS. 8 and 9, to accommodate barbell handles of various and varying diameters, a pair of compressible gaskets 135, 140 (e.g., foam or elastomer inserts), each having a concave side, are inserted into each concave trough of the bases 180, 185. Protrusions 136, 141 extending from the top and bottom of each gasket plug into corresponding apertures 137, 142 in walls forming the structure of the channel 145. The gaskets 135, 140 snugly grip the barbell handle, and resist rotation and sliding of the handle in the channel 145 relative to the bases 180, 185.

An intermediate section 125, 130 couples each base 180, 185 to each handle 105, 110. The intermediate section is sufficiently strong, durable and rigid to prevent appreciable strain (i.e., stretching, bending and twisting) of the intermediate section during normal use.

Each handle section 105 110 is a curved, generally U or C-shaped, grippable structure that defines an opening 120 through which fingers of a user's gripping hand may extend. The opening 120 is disposed between the top of the handle section 105, 110 and the intermediate sections 125, 130. In a preferred embodiment, the handle formed by the two handle sections 105, 110 when the holder is in a closed position is configured (i.e., shaped and sized) to be similar to the handle of a kettlebell.

Figure 7:
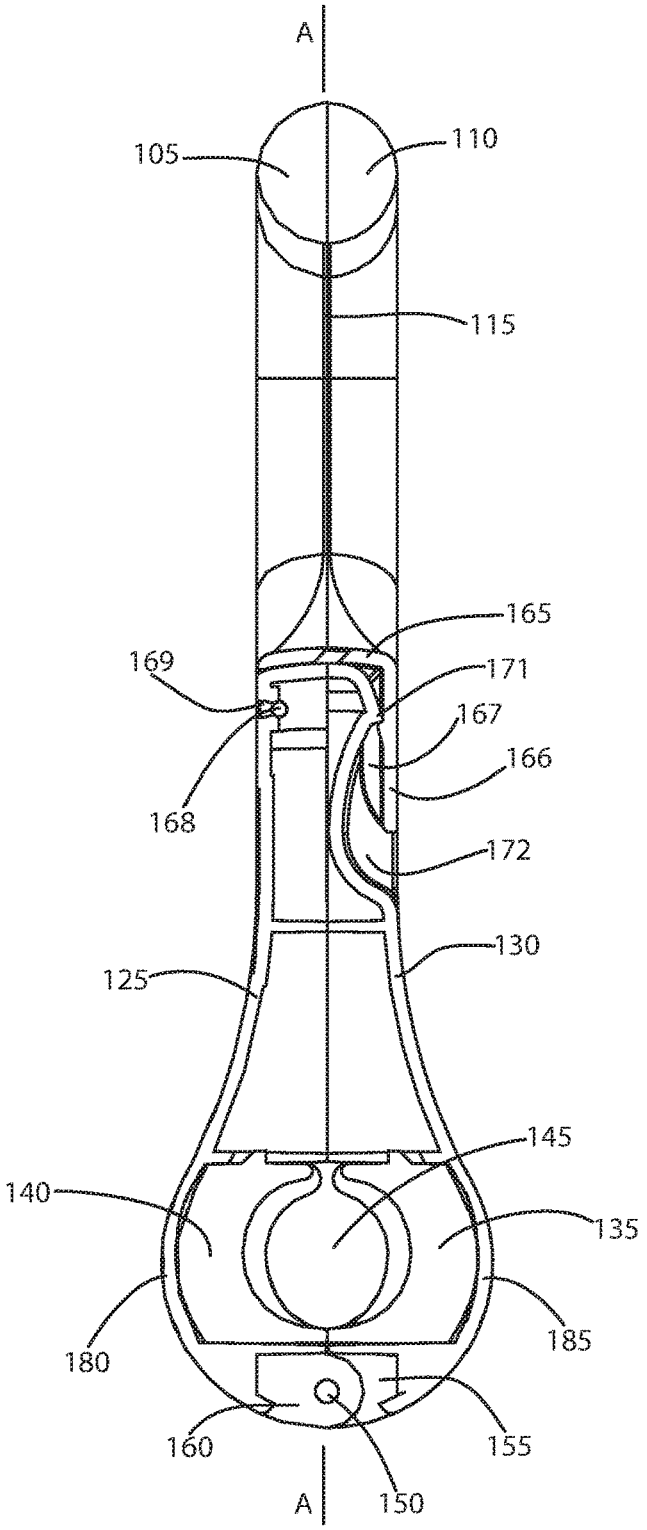
FIG. 7 is a section (Section A-A of FIG. 3) view of an exemplary holder in a closed configuration according to principles of the invention.

A locking mechanism 170 is provided to secure the bodies together, in abutting relationship, when the holder 100 is in a closed position. An exemplary locking mechanism 170 is a pivoting cam latch. As shown in the section view of FIG. 7, and the exploded views of FIGS. 8 and 9, the cam latch is a saddle shaped structure that includes a shaft 168 for rotating snap fit engagement in a channel in the intermediate section (e.g., intermediate section 125) of one of the bodies. The cam latch pivots about the longitudinal axis of the shaft. Other pivoting attachments may be utilized without departing from the scope of the invention. A first support 169 extends upwardly from the shaft 168 to a first edge of a shoulder 165. The shoulder has an opposite second edge and a width, w, measured from the first edge to the second edge. The shoulder is wide enough to extend from the outer surface of the engaged portion of one intermediate section 125, to the outer surface of the opposite intermediate section 130. A tab 166 extends downwardly from the second edge of the shoulder 165. A cam 167 protrudes from the inner side of the tab 166 (i.e., the side facing the engaged intermediate section 130). The engaged intermediate section 130 includes a concavity 172 with a ledge 171. The height of the concavity 172 exceeds the height of the tab 166. The width of the concavity 172 exceeds the width of the tab 166. The top of the cam 167 fits snugly beneath and in abutting relationship with the ledge 171 when the locking mechanism 170 is pivoted into the locked position. The bottom of the ledge may include a lip, trough or undercut to enable snap-fit coupling of the cam 167. In this manner, the locking mechanism secures the bodies together. When the holder 100 is in a closed configuration and the handle sections are gripped by a user's hand, the locking mechanism 170 provides positive locking.

Optionally, in one embodiment, to maintain correct alignment of the bodies in the closed position, a plurality of mating male pins 114 and female sleeves 112 may be formed in the abutting sides of bodies. During closure, the pins 114 slide into the sleeves 112, to register the bodies. This feature is optional, not required.

Figure 11:
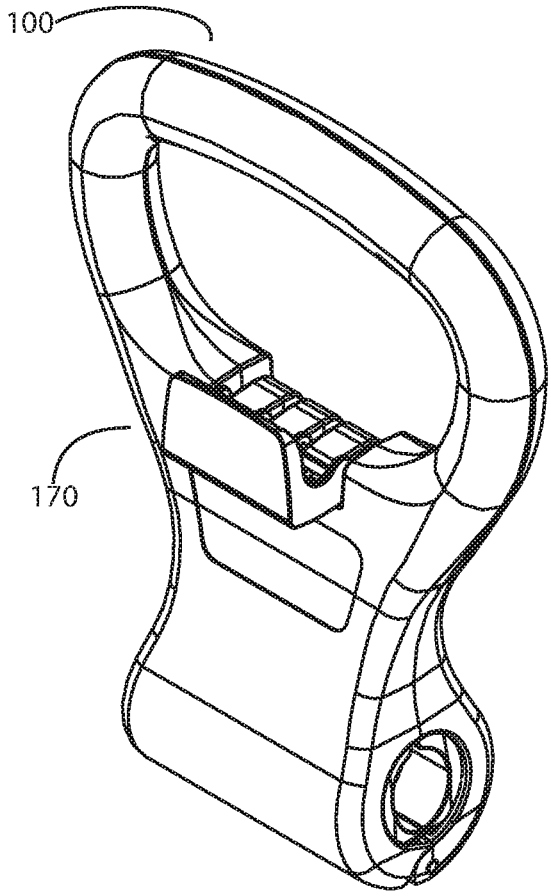
FIG. 11 is a perspective view of an exemplary holder in an unlocked configuration according to principles of the invention.
Figure 12:
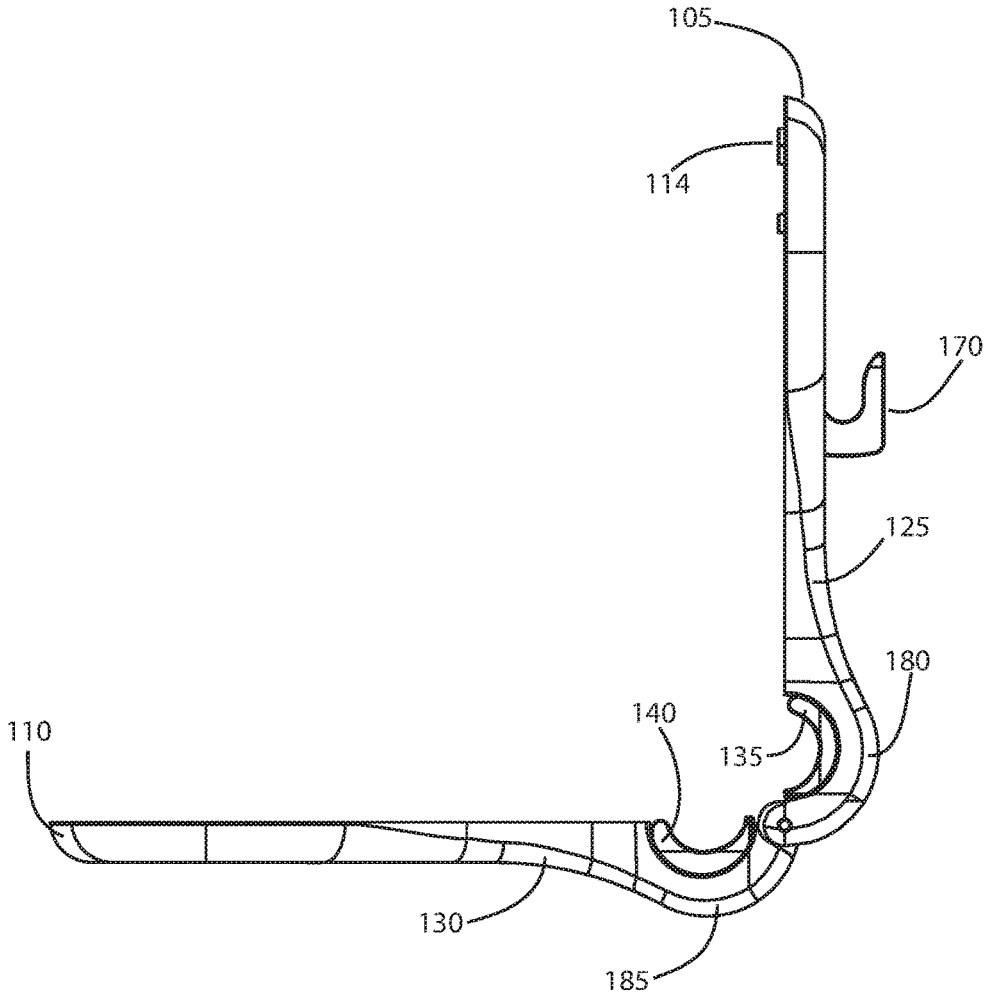
FIG. 12 is a side view of an exemplary holder in an opened configuration according to principles of the invention.
Figure 13:
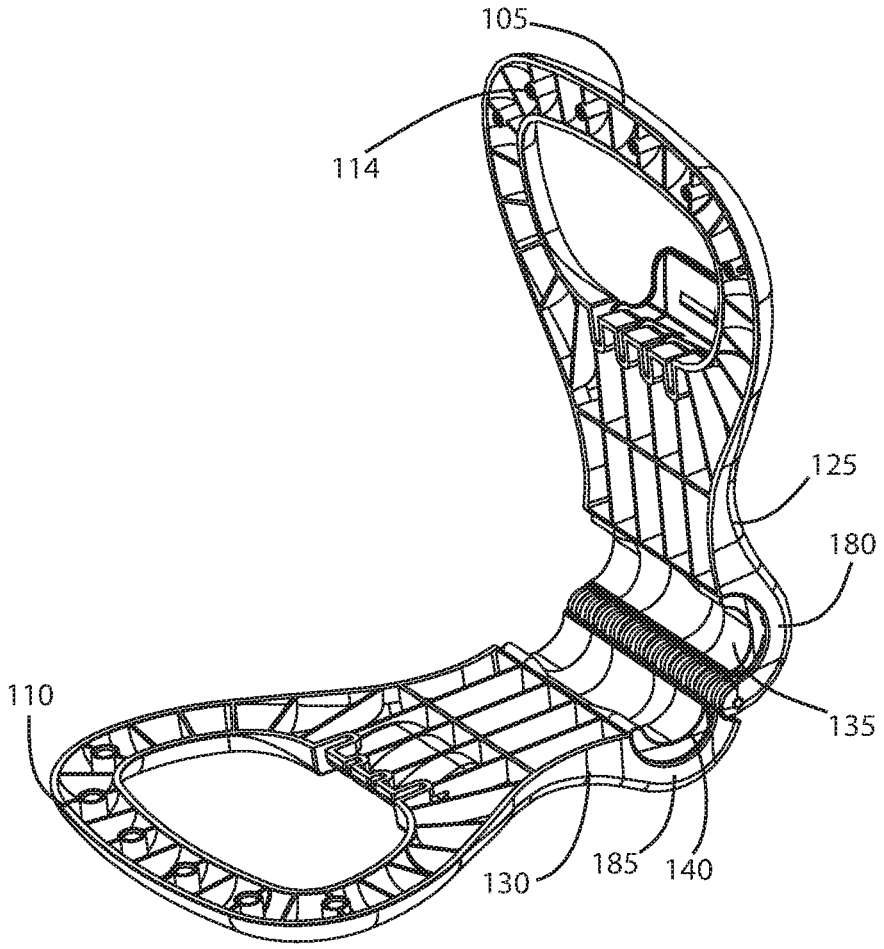
FIG. 13 is a perspective view of an exemplary holder in an opened configuration according to principles of the invention.
Figure 14:
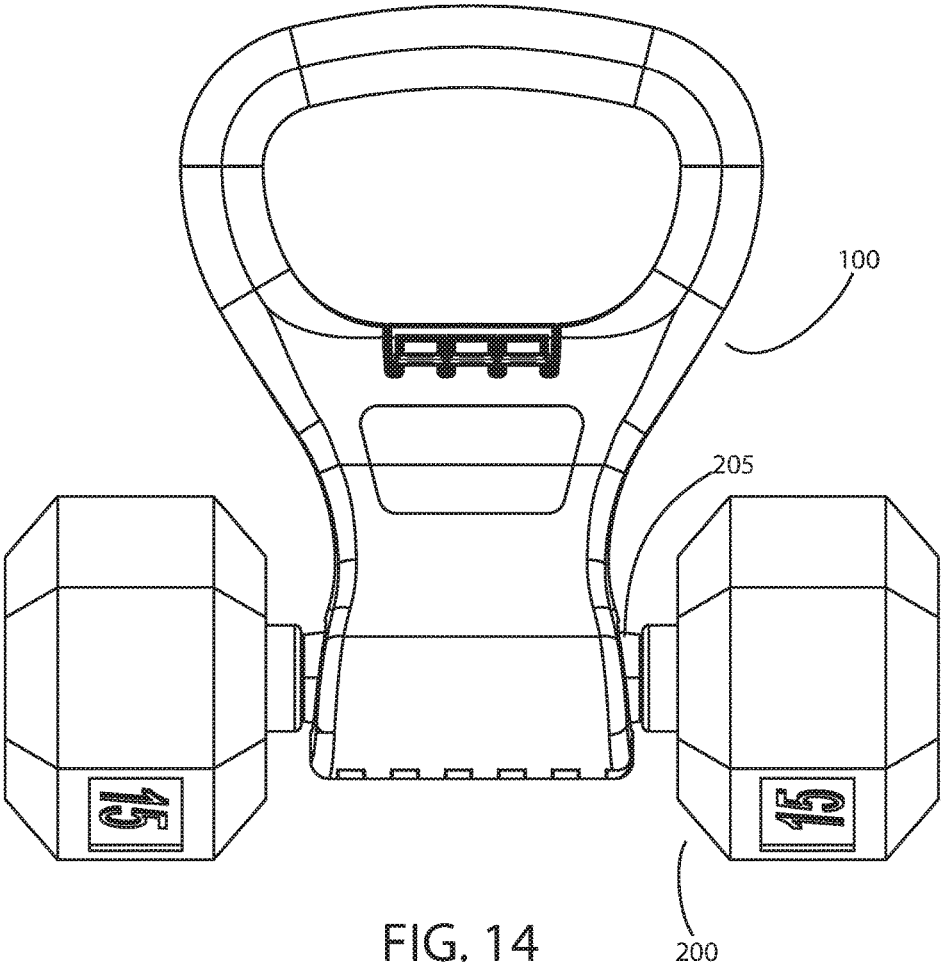
FIG. 14 is a back view of an exemplary holder that is holding a dumbbell according to principles of the invention.
Figure 15:
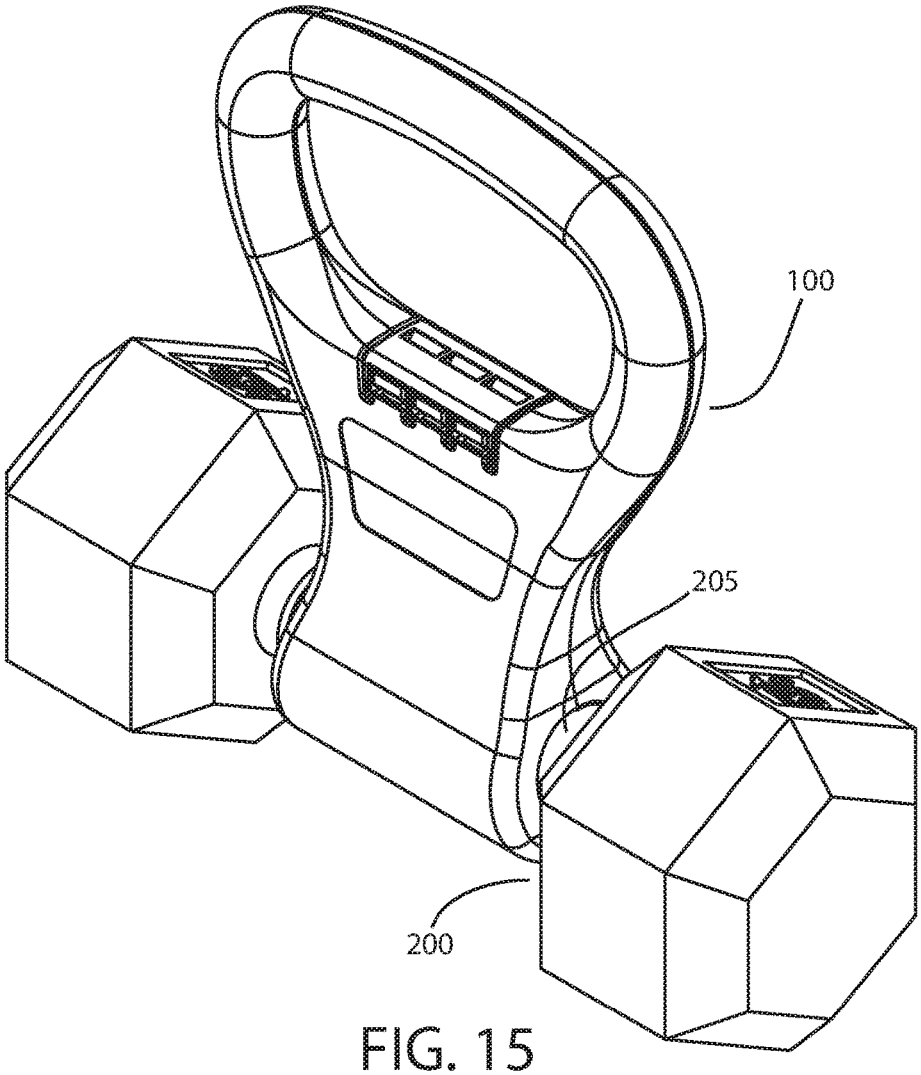
FIG. 15 is a perspective view of an exemplary holder that is holding a dumbbell according to principles of the invention.

Referring now to FIG. 11 through 15, the holder is shown in various states of use. In FIG. 11, the locking mechanism 170 is pivoted to an unlocked position. In FIGS. 12 and 13, the locking mechanism 170 is in the unlocked position and the holder 100 is pivoted to an open position. In FIGS. 14 and 15, the holder 100 is in a closed position and the locking mechanism 170 is in a locked position and a barbell 200 is held by the holder, with the handle 205 of the barbell 200 extending through and securely gripped by the gaskets 135, 140 within the channel 145.

The invention is not limited to use with any particular type of barbell or dumbbell. A holder according to principles of the invention may be utilized with free weight barbells as well as molded, cast and forged barbells. So long as the handle of the barbell or dumbbell may be received and gripped by the holder 100, a holder 100 according to principles of the invention may be used with the barbell or dumbbell.

A holder according to principles of the invention offers several advantages. First, the handle sections which combine to form a handle when in abutting arrangement provide a lock when gripped. When the handle is gripped, the holder is closed. Second, the cam latch provides a means of locking in addition to gripping. Thus, even if a grip is released the holder will remain closed when the cam latch is locked. Third, the elastomeric gaskets ensure snug gripping of the handle of a held barbell. This accommodates various and varying handle diameters, without slipping, rotating and sliding within the channel. Fourth, the bottom hinge prevents unintended dislodging (e.g., dropping or otherwise releasing) of a held barbell. As long as the hinge remains intact, a barbell cannot fall from the bottom of the holder 100.

Each body, including the bases 180, 185, intermediate sections 125, 130 and handle sections 105, 110, may be comprised of molded (e.g., injection molded) plastic. Ribs, thin walls, gussets and other reinforcements may be formed in the structures to enhance stability and structural integrity. All outer surfaces are preferably smooth rounded, avoiding sharp corners and edges.

The holder 100 may be produced using any suitable manufacturing techniques known in the art for the chosen material, such as (for example) injection, compression, structural foam, or rotary molding, casting and milling. Preferably the manufacturing technique is suitable for mass production at relatively low cost per unit, and results in an aesthetically acceptable product with a consistent acceptable quality and structural characteristics.

A holder 100 according to principles of the invention may be comprised of metals, alloys, composites and/or any of various plastics. In an exemplary implementation, the holder is comprised of an injection molded plastic. Nonlimiting examples are Acrylonitrile Butadiene Styrene, Nylons have been compounded with reinforcements, Polycarbonate, High Density Polyethylene, High Impact Polystyrene, Polyurethane, and Polyvinylchloride. A plasticizer, such as a phthalate ester, may be included in the plastic to enhance flexibility and durability. While many other materials may be used alone or in combination with the aforementioned materials and/or other materials, without departing from the scope of the present invention, preferably the material is relatively inexpensive, easy to use in manufacturing operations and results in an aesthetically acceptable, durable, high tensile strength product. The material may further include additives to provide desired properties such as desired colors, structural characteristics, glow-in-the dark properties and thermal reactivity (e.g., color changes according to heat).

By way of example and not limitation, the holder 100 may optionally be formulated to change color when it reaches a predetermined or higher temperature. This can be accomplished by mixing a thermochromic additive (e.g., thermochromic pigment) to the base material in an amount that is sufficient to achieve a desired color changing range. As an example, a mixture of approximately 5% to 30% (pbw) of Matsui International Co., Inc.'s Chromicolor concentrate may be introduced to the base material, to provide a plastic structure that visibly changes color at a determined elevated temperature, such as approximately 90 degrees Fahrenheit or higher.

Alternatively, a photochromic additive may be added to the base material in an amount that is effective to achieve a desired color change when the holder 100 is exposed to certain lighting conditions. As an example, a mixture of approximately 5% to 35% (pbw) of Matsui International Co., Inc.'s Photopia additive may be introduced to the base material, to provide a plastic structure that visibly changes color in the presence of sunlight or ultraviolet light.

As another alternative, phosphorescent polymer additives, such as aluminate based phosphors, may be added to adsorb light energy and continue to release that energy as visible light after the energy source is removed. Advantageously, such an embodiment provides a holder 100 that is easy to locate in darkened conditions, making the device easy to spot even at nighttime and in a dark room.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A holder for a dumbbell having a handle, the holder comprising a first body comprising a first handle section, a first intermediate section and a first base section, the first intermediate section being disposed between and connecting the first handle section to the first base section;

a second body comprising a second handle section, a second intermediate section and a second base section, the second intermediate section being disposed between and connecting the second handle section to the second base section;

the first base section including a first bottom, and the second base section including a second bottom, and a hinge coupling the first bottom to the second bottom, the hinge enabling pivoting motion of the first body relative to the second body between a closed position and an opened position, and in the opened position the first body pivoting away from the second body and in the closed position the first body abutting the second body; and the first base section including a first concave trough, and the second base section including a second concave trough, and the first base section and the second base section being aligned and abutting in the closed position, and the first concave trough and the second concave trough being aligned and defining a channel in the closed position, the channel being sized and shaped to receive the handle of the dumbbell; and the hinge coupling the first bottom to the second bottom preventing the received handle of the dumbbell from dislodging from the channel through the first bottom and second bottom; and a locking mechanism attached to the first intermediate section by a lock hinge and releasably securing the first intermediate section to the second intermediate section.

2. The holder of claim 1, the hinge comprising a plurality of barrel sections, including a first set of barrel sections extending from the first bottom of the first base section, and a second set of barrel sections extending from the second bottom of the second base section, the first set of barrel sections and the second set of barrel sections interdigitating and being in alignment, and a shaft extending through the first set of barrel sections and the second set of barrel sections, the first set of barrel sections pivoting about the shaft relative to the second set of barrel sections; and the holder further comprising a first compressible gasket and a second compressible gasket, the first compressible gasket being in the first concave trough, and the second compressible gasket being in the second concave trough, the first compressible gasket and second compressible gasket being in opposed alignment in the closed position, the handle of the dumbbell being received between the first compressible gasket and the second compressible gasket in the closed position.

3. The holder of claim 2, further comprising the locking mechanism pivoting between an unlocked position and a locked position, the locking mechanism including a cam latch, and the second intermediate section including a catch, the cam latch releasably engaging the catch in the locked position.

4. The holder of claim 3, the first handle section comprising a generally U-shaped first handle section, and the second handle section comprising a generally U-shaped second handle section, and the first handle section being aligned with and abutting the second handle section in the closed position and together forming a holder handle, gripping of the holder handle preventing pivoting from the closed position to the opened position.

5. The holder of claim 2, the first compressible gasket being coextensive with the first concave trough, and the second compressible gasket being coextensive with the second concave trough.

6. The holder of claim 1, the locking mechanism pivoting between an unlocked position and a locked position, the locking mechanism including a cam latch that pivots about the lock hinge, and the second intermediate section including a cavity with a catch, the cam latch releasably engaging the catch in the locked position.

7. The holder of claim 6, the cavity having a top and a bottom and the catch comprising a protruding ledge at the top of the cavity.

8. The holder of claim 1, the locking mechanism pivoting between an unlocked position and a locked position, the locking mechanism including a latch that pivots about the lock hinge, and the second intermediate section including a protruding ledge, the latch releasably engaging the protruding ledge in the locked position.

9. The holder of claim 8, the first handle section comprising a generally U-shaped first handle section, and the second handle section comprising a generally U-shaped second handle section, and the first handle section being aligned with and abutting the second handle section in the closed position and together forming a holder handle, gripping of the holder handle preventing pivoting from the closed position to the opened position.

10. The holder of claim 1, the hinge comprising a plurality of barrel sections, including a first barrel section extending from the first bottom of the first base section, and a second barrel section extending from the second bottom of the second base section, the first barrel section and the second barrel section being in alignment, and a shaft extending through the first barrel section and the second barrel section, the first barrel section pivoting about the shaft relative to the second barrel section.

11. The holder of claim 1, the hinge comprising a plurality of barrel sections, including a first set of barrel sections extending from the first bottom of the first base section, and a second set of barrel sections extending from the second bottom of the second base section, the first set of barrel sections and the second set of barrel sections interdigitating and being in alignment, and a shaft extending through the first set of barrel sections and the second set of barrel sections, the first set of barrel sections pivoting about the shaft relative to the second set of barrel sections.

12. The holder of claim 1, further comprising a first gasket and a second gasket, the first gasket being in the first concave trough, and the second gasket being in the second concave trough, the first gasket and second gasket being in opposed alignment in the closed position, the handle of the dumbbell being received between the first gasket and the second gasket in the closed position.

13. The holder of claim 1, further comprising a first compressible gasket and a second compressible gasket, the first compressible gasket being in the first concave trough, and the second compressible gasket being in the second concave trough, the first compressible gasket and second compressible gasket being in opposed alignment in the closed position, the handle of the dumbbell being received between the first compressible gasket and the second compressible gasket in the closed position.

14. The holder of claim 1, further comprising a first compressible gasket and a second compressible gasket, the first compressible gasket being in the first concave trough and coterminous with the first concave trough, and the second compressible gasket being in the second concave trough and coterminous with the second concave trough, the first compressible gasket and second compressible gasket being in opposed alignment in the closed position, the handle of the dumbbell being received between the first compressible gasket and the second compressible gasket in the closed position.

15. The holder of claim 1, the locking mechanism pivoting between an unlocked position and a locked position, the locking mechanism including a cam latch that pivots about the lock hinge, and the second intermediate section including a catch, the cam latch releasably engaging the catch in the locked position.

16. The holder of claim 1, the first handle section comprising a generally U-shaped first handle section, and the second handle section comprising a generally U-shaped second handle section, and the first handle section being aligned with and abutting the second handle section in the closed position and together forming a holder handle.

17. The holder of claim 1, the first handle section comprising a generally U-shaped first handle section, and the second handle section comprising a generally U-shaped second handle section, and the first handle section being aligned with and abutting the second handle section in the closed position and together forming a holder handle, gripping of the holder handle preventing pivoting from the closed position to the opened position.

* * * * *